US006582288B2

(12) United States Patent
Yeh et al.

(10) Patent No.: US 6,582,288 B2
(45) Date of Patent: Jun. 24, 2003

(54) DIAPHRAGM FOR CHEMICAL MECHANICAL POLISHER

(75) Inventors: Pei Wei Yeh, Tainan (TW); Sun Kuo Lang, Tainan (TW)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/905,512

(22) Filed: Jul. 13, 2001

(65) Prior Publication Data

US 2002/0072314 A1 Jun. 13, 2002

(30) Foreign Application Priority Data

Jul. 14, 2000 (TW) ..... 89114156 A
Jun. 26, 2001 (TW) ..... 89114156 A01

(51) Int. Cl.[7] ..... B24B 5/00
(52) U.S. Cl. ..... 451/288; 451/287
(58) Field of Search ..... 451/288, 285–287, 451/41, 388–389

(56) References Cited

U.S. PATENT DOCUMENTS

| | | | | |
|---|---|---|---|---|
| 6,033,290 | A | 3/2000 | Gurusamy et al. | |
| 6,036,583 | A | 3/2000 | Perlov et al. | |
| 6,200,199 | B1 | 3/2001 | Gurusamy et al. | |
| 6,241,593 | B1 * | 6/2001 | Chen et al. | 451/288 |
| 6,277,009 | B1 * | 8/2001 | Chen et al. | 451/288 |
| 6,406,361 | B1 * | 6/2002 | Zuniga et al. | 451/287 |
| 6,450,868 | B1 * | 9/2002 | Zuniga et al. | 451/288 |

* cited by examiner

*Primary Examiner*—Lee D. Wilson
(74) *Attorney, Agent, or Firm*—Fish & Richardson P.C.

(57) ABSTRACT

A diaphragm for a chemical mechanical polisher is composed of a rubber layer and a fiber layer. The size and shape of the diaphragm are suitably designed according to a gap and relative shifting between the rotary unit and holder to prevent creasing of the diaphragm and thereby decrease friction with a sidewall of the rotary unit and holder. The fibrous layer can improve the strength of the diaphragm in order to improve the lifetime of the diaphragm, reduce the frequency of maintenance of the polisher, and increase throughput.

21 Claims, 3 Drawing Sheets

DIAPHRAGM FOR CHEMICAL MECHANICAL POLISHER

BACKGROUND

The present invention relates to a chemical mechanical polisher or chemical mechanical polishing (CMP) machine, and more particularly to a diaphragm between a rotary unit and a holder of a pad conditioner in the CMP machine.

Two planarization techniques, specifically spin-on-glass (SOG) and chemical mechanical polishing (CMP), have been widely used in industry. As the semiconductor fabrication technique has approached the deep sub-micron regime, the required level of planarity can not be achieved using the technique of spin-on-glass. The only technique to provide the required level of planarity in a very large scale integration (VLSI) or ultra large scale integration (ULSI) is chemical mechanical polishing. In the chemical mechanical polishing process, a polishing procedure similar to that used by a grinder is used with the aid of a chemical reagent. The uneven surface profile is thus smoothed. With an appropriate control of the polishing parameters, about 90% of planarity can be achieved using chemical mechanical polishing.

A chemical mechanical polisher or chemical mechanical polishing (CMP) machine operates by holding and rotating a wafer with a holder on a polishing pad supplied with polishing slurry thereon. After an extended polishing time, some abrasive particles in the polishing slurry become embedded and trapped in the polishing pad, causing the performance of the polishing pad to decay with time. For example, the substrate polished on the polishing pad can be scratched and damaged from the embedded abrasive and thus decreasing the polishing uniformity. Therefore, a pad conditioner is generally employed in a CMP machine to recondition the used polishing pad and recover original polishing condition and state. Typically, the pad conditioner has a rotary unit and a holder. In the bottom of the holder is a diamond-coated conditioning disk used to remove embedded abrasive and contaminated slurry and to recover original polishing condition. Further description about the pad conditioner of a CMP machine may be found in U.S. Pat. No. 6,200,199, the entirety of which is incorporated by reference.

A conventional pad conditioner generally includes a robot arm. A rotary unit is assembled in one end of the arm and activated with a power supply device to force the holder thereunder to rotate. The diamond disk on the bottom of the holder is employed to remove embedded abrasives and contaminated slurry on a polishing pad and to recover the original polishing condition of the polishing pad. In addition, an elastic and flexible rubber diaphragm is disposed between the rotary unit and the holder. During the conditioning operation, the rubber diaphragm can become jammed and contorted, forming a crease because of relative dislocation of the rotary unit and the holder. The rubbing of the diaphragm against the sidewall of the rotary unit and the holder generates friction and force on the diaphragm. The accumulated strain on the diaphragm caused by the friction results in fatigue and wear, and consequently results in breakage. Therefore, lifetime of the diaphragm is reduced. Maintenance frequency of the CMP machine is raised, resulting in a decrease of the throughput of the CMP machine.

SUMMARY

In one aspect, the invention is directed to a diaphragm for chemical mechanical polisher that has an elastic layer to connect a rotary unit and a holder and a fibrous layer attached on the elastic layer to reinforce strength of the elastic layer. The holder is fitted into the rotary unit, and a gap between the rotary unit and the holder is sealed by the elastic layer.

Implementations of the invention may include one or more of the following features. The fibrous layer may include a net structure, the elastic layer may be composed of rubber, the elastic layer and the fibrous layer may be annular, and the diaphragm may rotate with the rotary unit.

In another aspect, the invention is directed to a diaphragm for a chemical mechanical polisher. The diaphragm has an external sealing ring mounted on an internal sidewall of a rotary unit, an internal sealing ring mounted on an external sidewall of an holder, and a connect ring smoothly connected between the external sealing ring and the internal sealing ring. The holder is fitted into the rotary unit, and the external sidewall of the holder is adjacent to the internal sidewall of the rotary unit. The width of the connect ring is designed according to a gap distance and a maximum relative shift distance between the external sealing ring and the internal seal ring.

Implementations of the invention may include one or more of the following features. The external sealing ring, the connect ring and the internal ring may be integrally formed. Each of the external sealing ring, the connect ring, and the internal ring may be composed of a fibrous layer and an elastic layer. The fibrous layer may include a net structure, and the elastic layer may be composed of rubber. The diaphragm may rotate with the rotary unit.

In another aspect, the invention is directed to a chemical mechanical polisher. The polisher has a rotary unit, a holder fitted into the rotary unit and a diaphragm composed of a rubber layer and a fibrous layer connects the rotary unit and the holder, and seals a gap between the rotary unit and the holder.

Implementations of the invention may include one or more of the following features. A carrier may hold a substrate, and a polishing surface may polish the substrate. The rotary unit, holder and diaphragm may be part of a conditioner to condition the polishing surface. A bottom surface of the holder may recondition a polishing pad by rotating thereon. The bottom of the holder may comprise a diamond layer. The fibrous layer may include a net structure, the elastic layer may be composed of rubber, the diaphragm may be annular, and the diaphragm may rotate with the rotary unit.

A potential advantage of the invention is that the strength and durability of the diaphragm can be increased to prevent failure during operation and improve the lifetime of the diaphragm.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION

In a chemical mechanical polisher, an improved diaphragm with enhanced strength and durability can be composed of a fiber layer and an elastic rubber layer. The size and shape of the diaphragm are designed according to the gap and relative shift distances between the rotary unit and holder to avoid creasing and to improve the lifetime of the diaphragm.

Figure 1:
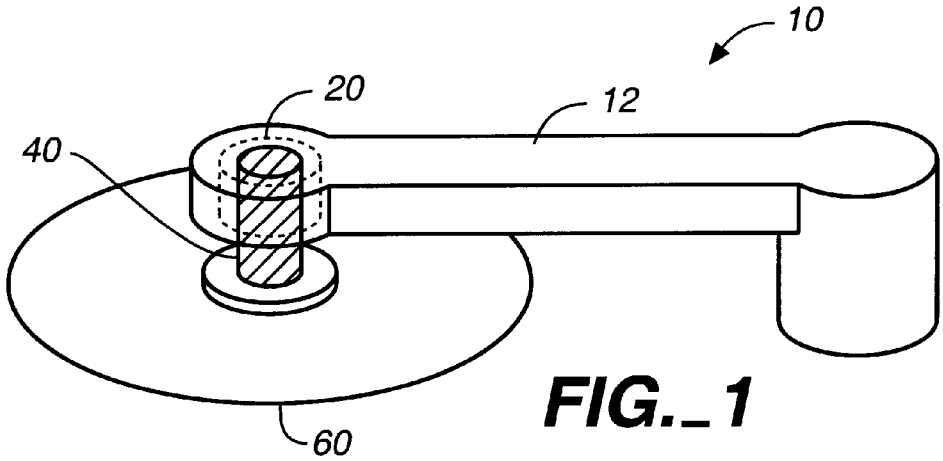
FIG. 1 is a schematic perspective view of a pad conditioner in a CMP machine in accordance with the prior art.

FIG. 1 illustrates a schematic perspective view of a pad conditioner in a CMP machine. A pad conditioner 10 includes a robot arm 12. A rotary unit 20 is positioned or assembled in one end of the arm 12, while a power supply device (not shown), such as a motor, is disposed in the other end of the arm 12. The rotary unit 20 is activated with the power supply device through a power transmission device (not shown), such as a transmission belt. Alternatively, the power supply device could be at the same end of the arm as the rotary unit 20. A control system (not shown) can be further set in the CMP machine to control the motion of the arm 12 to move a disc holder 40 on a polishing pad 60. The holder 40 rotates with the rotary unit 20, and has a diamond disk on the bottom, which is used to conditioning the polishing pad, e.g., by removing embedded abrasive and contaminated slurry and recovering the original polishing condition of the polishing pad 60.

Figure 2:
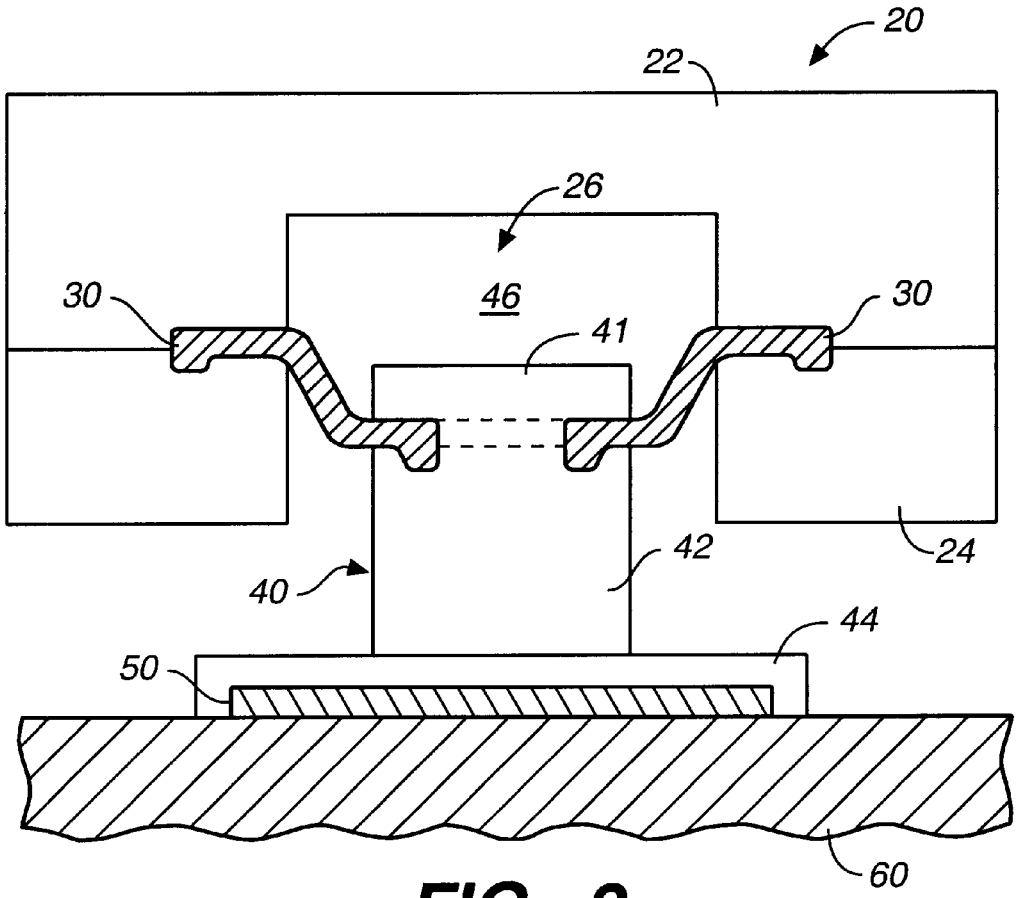
FIG. 2 is a schematic cross-sectional view of a pad conditioner in a CMP machine according to the present invention.

FIG. 2 shows a schematic cross-sectional view of a portion of one end of the pad conditioner 10 in the CMP machine. The rotary unit 20 includes an upper portion 22 and a lower portion 24, and the holder 40 includes a shaft 42 (which can include a clamp piece 41) and a disk 44 disposed on the bottom of the shaft 42. There is a cylindrical hole 26 in the bottom center of the rotary unit 20, and the shaft 42 of the holder 40 is fitted into the hole 26 of the rotary unit 20.

A diaphragm 30 is disposed between the rotary unit 20 and the shaft 42. The diaphragm 30 is generally annular, with an external portion of the diaphragm 30 embedded into the rotary unit 20, e.g., by being clamped between the upper and lower portions 22 and 24, and an internal portion of the diaphragm 30 embedded into the shaft 42, e.g., by being clamped between the clamp piece 41 and the remainder of the shaft 42. By pressurizing the chamber 46 between the diaphragm 30 and the upper portion 22 of the rotary unit 20, the holder 40 is driven downwardly to load the diamond disk 44 against the polishing pad 60.

When the rotary unit 20 is activated and rotated, the diaphragm 30 and the shaft 42 are rotated with the rotary unit 20 to rotate the holder 40. In the bottom of the holder 40 is diamond disk 44 covered with a diamond screen. By rotating the diamond disk 44, the trapped abrasive and contaminated slurry on the polishing pad 60 can be removed and the original polishing condition can be recovered.

Figure 3:
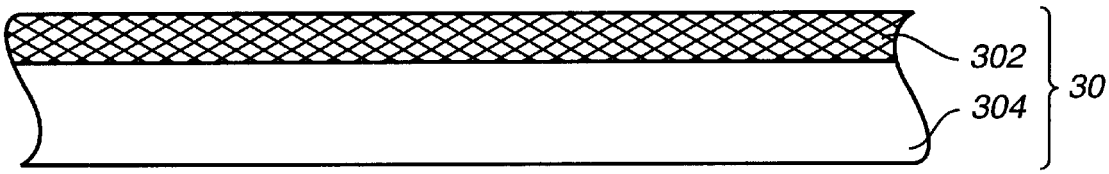
FIG. 3 shows components of a diaphragm of the present invention.

FIG. 3 illustrates the components of the diaphragm 30. The diaphragm 30 includes a flexible and elastic rubber layer 304, and a fiber layer 302 with net structure attached on the rubber layer 304. The rubber layer 304 can use a traditional rubber material for the diaphragm 30. The fiber layer 302 is made of a reinforced fiber, such as nylon 66 or other similar materials. A suitable adhesive can be used to combine the fiber layer 302 and the rubber layer 304.

Since the fiber layer 302 is employed on the diaphragm 30 of the present invention, the strength and durability of the diaphragm 30 can increased and the strain caused from friction can be reduced or eliminated. The quality of the diaphragm 30 is improved, and incidents of breakage can be avoided even the diaphragm 30 is experiencing rotation and relative motion relative to the rotary unit 20, so that the lifetime of the diaphragm 30 can be therefore improved.

Figure 4:
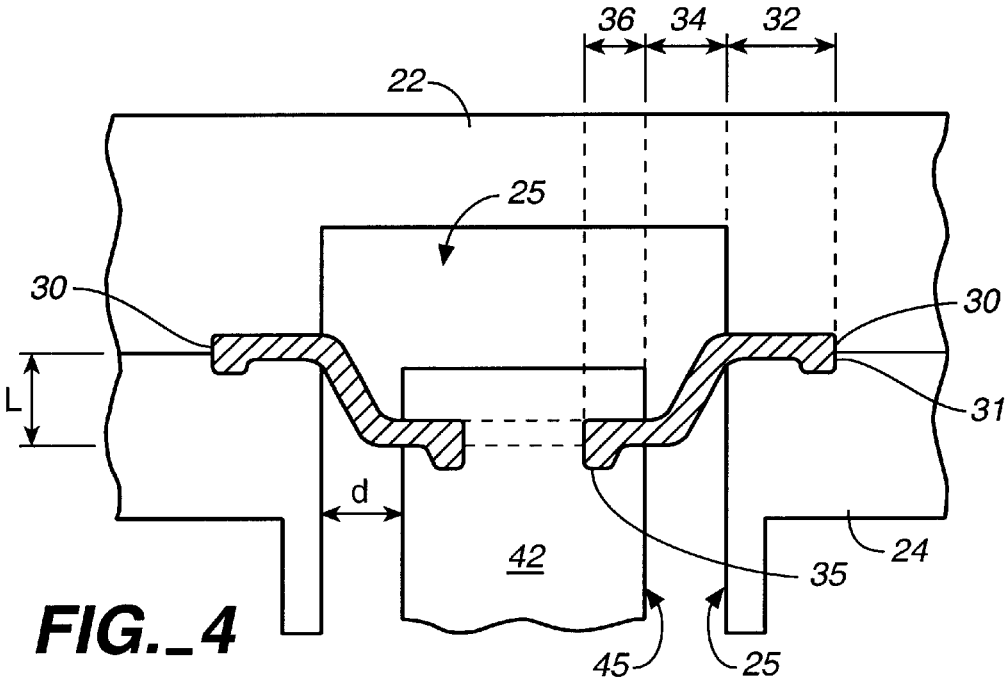
FIG. 4 is a schematic cross-sectional view of the diaphragm of the present invention.
Figure 5:
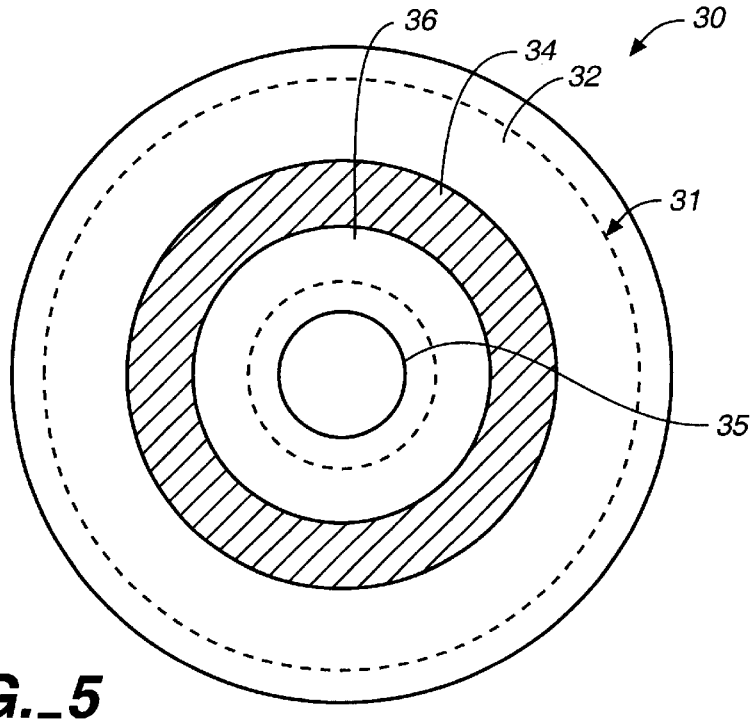
FIG. 5 is a schematic top view of the diaphragm of the present invention.
Figure 6:
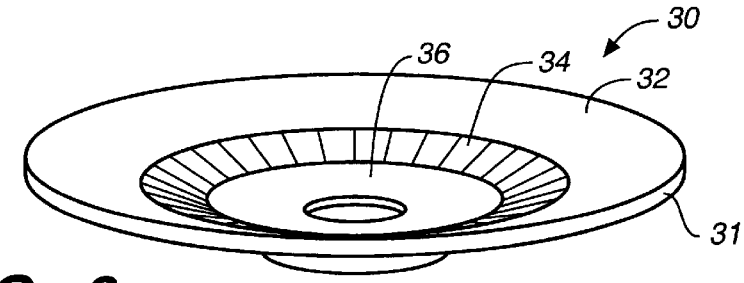
FIG. 6 is a schematic three-dimensional view of the diaphragm of the present invention.

The design of the diaphragm is described further below. FIGS. 4, 5 and 6 are schematic cross-sectional, top and three-dimensional views of an implementation of the invention, respectively. Referring to FIGS. 4, 5 and 6 simultaneously, the shaft 42 is fitted into the rotary unit 20. In the internal surface of the rotary unit 20 is an internal sidewall 25, and in the external surface of the shaft 42 is an external sidewall 45. There is a gap with a distance d between the rotary unit 20 and shaft 42, i.e. between the internal sidewall 25 and external sidewall 45.

The diaphragm 30 can look like an annular dish (see FIG. 6), and can be formed integrally. The diaphragm 30 includes three portions, an external sealing ring 32, an internal sealing ring 36, and a connect ring 34 therebetween. In the external bottom of the external sealing ring 32 has an external ring protrusion 31 engaged with the groove of the lower portion 24 to trap and mount the external sealing ring 32 in the rotary unit 20. The external sealing ring 32 is generally located between the upper portion 22 and lower portion 24 for convenient installation. Similarly, in the internal bottom of the internal sealing ring 36 has an internal ring protrusion 35 to engage and mount the internal sealing ring 36 into groove of the shaft 42.

The connect ring 34 is smoothly connected and integrated between the external sealing ring 32 and internal sealing ring 36. The diaphragm 30 can seal the gap between the rotary unit 20 and the shaft 42 of the holder 40 to achieve airtight of the internal chamber 46. Selection of the size of the connect ring 34 can be important. If the connect ring 34 is too wide, creasing readily occurs between the shaft 42 and rotary unit 20 because of rotation and relative motion. This creasing results in distortion and warpage of the membrane, and can even results in breakage of the membrane. Hence, the width of the connect ring 34 can be designed according to the gap distance d and the maximum relative shift distance L between the external sealing ring 32 and internal sealing ring 36. The width of the diaphragm 30 can be a little larger than $(L^2+d^2)^{1/2}$, preferably 1.1–1.6 times, and most preferably 1.1–1.3 times. An unnecessary portion of the connect ring 34 is removed and the probability of creasing can be reduced. The friction of the connect ring 34 between the internal sidewall 25 and external sidewall 45 can be therefore reduced. Hence, the lifetime of the diaphragm 30 is increased.

Figure 7:
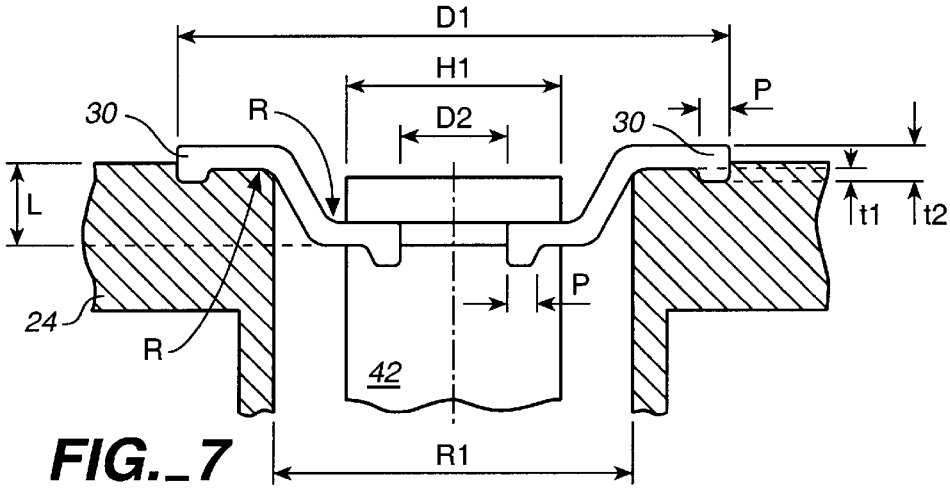
FIG. 7 is a design diagram of the diaphragm of the present invention.

In order to further explain the advantages and workability of the present invention, an exemplary implementation is described. Referring to FIG. 7, the internal diameter R1 of the internal hole of the lower portion 24 can be 35 mm, and the external diameter H1 of the shaft 42 can be 26 mm. The thickness t1 of the diaphragm 30 including the fiber layer 302 and rubber layer 304 can be 2 mm. The external diameter D1 of the diaphragm 30 can be 46 mm, and the internal diameter D2 can be 19.5 mm. The width P and thickness (t2-t1) of the external ring protrusion 31 and internal ring protrusion 35 can be 1.8 mm and 1 mm, respectively, to mount the diaphragm 30 in the lower portion 24 and shaft 42. The distance d of the gap between the rotary unit 20 and shaft 42 can be 4.5 mm, and the relative shift distance L can be 6 mm. Therefore, the width of the connect ring 34 can be a little larger than 7.5 mm. The connecting portions of the connect ring 34 between the external sealing ring 32 and the internal sealing ring 36 can be designed in an arc shape to prevent strain being focused herein. The curve radius R in connect portions can be 1.5 mm. In order to prevent sharpness in the corner of the lower portion 24 neighbor the connect portion to damage the diaphragm 30, the corner also can be designed in an arc shape. Hence, the friction on the diaphragm 30 can be significantly decreased. The foregoing design example of the present invention is illustrated of the present invention rather than limiting of the present invention, and being included within the spirit and scope of the appended claims.

According to above description, the present invention discloses an improved diaphragm for chemical mechanical polisher. The diaphragm made of fiber layer and rubber layer can increase strength and durability to improve the diaphragm more durable. The designer can suitable design the size and shape of the diaphragm according to the gap distance and relative shift distance between the rotary unit and shaft to prevent creasing from occurring, and to reduce friction between the diaphragm and the sidewalls. The lifetime of the diaphragm can be therefore extended. Accordingly, frequency of maintenance of the chemical mechanical polisher can be reduced, and the throughput can be correspondingly increased.

To recap, the present invention can provide an improved diaphragm for chemical mechanical polisher. The diaphragm, suitably designed according for the gap distance and relative shift distance between the rotary unit and holder, can improve the strength and durability, and decrease friction from the sidewall of the rotary unit and holder to improve the lifetime of the diaphragm.

The diaphragm can have a rubber layer for connecting a rotary unit and a holder, and a fiber layer attached on the rubber layer to reinforce strength of the rubber layer. The holder can be fitted into the rotary unit, and a gap between the rotary unit and the holder can be sealed with the rubber layer and the fiber layer.

The diaphragm can also comprise an external sealing ring mounted on an internal sidewall of a rotary unit, an internal sealing ring mounted on an external sidewall of an holder, and a connect ring smoothly connected between the external sealing ring and the internal sealing ring. The connect ring can be designed according to the gap distance and maximum relative shift distance between the rotary unit and the holder. The external sealing ring, the connect ring and the internal sealing ring can be formed integrally. Each of the external sealing ring, the connect ring and the internal sealing ring can be made of a fiber layer and a rubber layer.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A diaphragm for chemical mechanical polisher, comprising:

an elastic layer to connect a rotary unit and a holder, wherein the holder is fitted into the rotary unit, and a gap between the rotary unit and the holder is sealed by the elastic layer; and a fibrous layer attached on the elastic layer to reinforce strength of the elastic layer.

2. The diaphragm according to claim 1, wherein the fibrous layer includes a net structure.

3. The diaphragm according to claim 1, wherein the elastic layer is composed of rubber.

4. The diaphragm according to claim 1, wherein the elastic layer and the fibrous layer are annular.

5. The diaphragm according to claim 1, wherein the diaphragm rotates with the rotary unit.

6. A diaphragm for a chemical mechanical polisher, comprising:

an external sealing ring mounted on an internal sidewall of a rotary unit;

an internal sealing ring mounted on an external sidewall of an holder, wherein the holder is fitted into the rotary unit, and the external sidewall of the holder is adjacent to the internal sidewall of the rotary unit; and a connect ring smoothly connected between the external sealing ring and the internal sealing ring, wherein the width of the connect ring is designed according to a gap distance and a maximum relative shift distance between the external sealing ring and the internal seal ring to reduce creasing of the connect ring.

7. The diaphragm according to claim 6, wherein the external sealing ring, the connect ring and the internal ring are integrally formed.

8. A diaphragm for a chemical mechanical polisher, comprising:

an external sealing ring mounted on an internal sidewall of a rotary unit;

an internal sealing ring mounted on an external sidewall of an holder, wherein the holder is fitted into the rotary unit, and the external sidewall of the holder is adjacent to the internal sidewall of the rotary unit; and a connect ring smoothly connected between the external sealing ring and the internal sealing ring, wherein the width of the connect ring is designed according to a gap distance and a maximum relative shift distance between the external sealing ring and the internal seal ring to reduce creasing of the connect ring, wherein each of the external sealing ring, the connect ring, and the internal ring are composed of a fibrous layer and an elastic layer.

9. The diaphragm according to claim 8, wherein the fibrous layer includes a net structure.

10. The diaphragm according to claim 8, wherein the elastic layer is composed of rubber.

11. The diaphragm according to claim 8, wherein the diaphragm rotates with the rotary unit.

12. A chemical mechanical polisher, comprising:

a rotary unit;

a holder fitted into the rotary unit; and a diaphragm composed of a rubber layer and a fibrous layer connects the rotary unit and the holder, and seals a gap between the rotary unit and the holder.

13. The polisher according to claim 12, further comprising a carrier to hold a substrate.

14. The polisher according to claim 12, further comprising a polishing surface to polish a substrate.

15. The polisher according to claim 12, wherein the rotary unit, holder and diaphragm are part of a conditioner to condition a polishing surface.

16. The polisher according to claim 15, wherein a bottom surface of the holder reconditions a polishing pad by rotating thereon.

17. The polisher according to claim 16, wherein in the bottom of the holder comprises a diamond layer.

18. The polisher according to claim 12, wherein the fibrous layer includes a net structure.

19. The polisher according to claim 12, wherein the elastic layer is composed of rubber.

20. The polisher according to claim 12, wherein the diaphragm is annular.

21. The polisher according to claim 12, wherein the diaphragm is rotated with the rotary unit.

* * * * *